US012686479B2

(12) United States Patent
Kawai

(10) Patent No.: US 12,686,479 B2
(45) Date of Patent: Jul. 21, 2026

(54) MARINE VESSEL PROPULSION MACHINE VENTILATION APPARATUS AND MARINE VESSEL PROPULSION MACHINE

(71) Applicant: HONDA MOTOR CO., LTD., Tokyo (JP)

(72) Inventor: Norikazu Kawai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 577 days.

(21) Appl. No.: 18/128,281

(22) Filed: Mar. 30, 2023

(65) Prior Publication Data

US 2024/0326970 A1 Oct. 3, 2024

(51) Int. Cl.
*B63H 20/00* (2006.01)

(52) U.S. Cl.
CPC ..... *B63H 20/002* (2013.01)

(58) Field of Classification Search
CPC .... B63H 20/00; B63H 20/001; B63H 20/002; B63H 20/32; F02B 61/045
USPC ..... 440/76, 77, 88 R
See application file for complete search history.

(56) References Cited

U.S. PATENT DOCUMENTS 5,095,844 A * 3/1992 Alexander ..... G01N 33/2847 422/537
5,445,547 A * 8/1995 Furukawa ..... F02B 61/045 440/88 R

FOREIGN PATENT DOCUMENTS

JP 2006-142965 6/2006

* cited by examiner

*Primary Examiner* — Daniel V Venne
(74) *Attorney, Agent, or Firm* — Amin, Turocy & Watson, LLP

(57) ABSTRACT

A marine vessel propulsion machine ventilation apparatus includes a first ventilation film (31), a second ventilation film (35), and an air chamber (27). The first ventilation film (31) permits passing of a gas, prevents passing of a liquid, and has one film surface facing the outside. The second ventilation film (35) permits passing of a gas, prevents passing of a liquid, and has one film surface facing the inside of a device accommodation case (19). Another film surface of each of the first ventilation film (31) and the second ventilation film (35) faces the air chamber (27).

17 Claims, 6 Drawing Sheets

MARINE VESSEL PROPULSION MACHINE VENTILATION APPARATUS AND MARINE VESSEL PROPULSION MACHINE

BACKGROUND OF THE INVENTION

Field of the Invention

The present invention relates to a ventilation apparatus of a marine vessel propulsion machine and a marine vessel propulsion machine.

Background Art

In a marine vessel propulsion machine such as an outboard motor, a main part of a propulsion mechanism such as a drive source or a speed reduction machine is accommodated in a device accommodation case. The propulsion mechanism is interconnected with a propulsion generation portion such as a screw exposed at the outside of the device accommodation case. A lower region of the device accommodation case is submerged together with the propulsion generation portion in the outside water of a sea, a river, or the like at the time of navigation of the marine vessel. Therefore, the device accommodation case basically has a sealed structure in order to prevent outside water from flowing into a device accommodation space. However, the device accommodation case needs to permit the flow of a gas (air) with the outside for the purpose of ventilation or heat waste of the device accommodation space, permitting inflation and deflation of air in the device accommodation space, or the like.

Therefore, a ventilation apparatus has been developed which permits the flow of a gas inside and outside the device accommodation case and which can prevent outside water from flowing into the device accommodation case (for example, refer to patent documents).

A ventilation apparatus described in Patent Document 1 (Japanese Unexamined Patent Application, First Publication No. 2006-142965) has an air intake port provided on a device accommodation case at a position that is not submerged in outside water, and a ventilation film is attached to the air intake port. The ventilation film is constituted of a film material that permits passing of a gas such as air and prevents passing of a liquid such as outside water. The ventilation apparatus can prevent the outside water from flowing into the device accommodation case and permit the flow of the gas between the device accommodation case and the outside by the function of the ventilation film arranged on the air intake port.

SUMMARY OF THE INVENTION

In the ventilation apparatus disclosed in Patent Document 1, one film surface of the ventilation film provided on the air intake port faces the outside, and the other film surface of the ventilation film faces the inside of the device accommodation case (device accommodation space). A device that requires cooling or lubrication by oil is accommodated in the device accommodation case which the other film surface of the ventilation film faces. Therefore, oil for device lubrication or device cooling may adhere to the other film surface of the ventilation film.

In the ventilation film attached to the air intake port, when outside water is applied to the one film surface in a state where the oil adheres to the other film surface, it is conceivable that a problem of ventilation of the gas at the film surface may occur. Accordingly, the present invention provides a ventilation apparatus of a marine vessel propulsion machine and a marine vessel propulsion machine capable of preventing outside water and oil from adhering to front and rear sides of a ventilation film and continuously maintaining good ventilation performance.

In order to solve the problem described above, the ventilation apparatus of the marine vessel propulsion machine and the marine vessel propulsion machine according to the present invention employ the following configurations.

A marine vessel propulsion machine ventilation apparatus according to an aspect of the present invention includes: a first ventilation film that permits passing of a gas, prevents passing of a liquid, and has one film surface facing the outside; a second ventilation film that permits passing of a gas, prevents passing of a liquid, and has one film surface facing the inside of a device accommodation case; and an air chamber which another film surface of each of the first ventilation film and the second ventilation film faces.

According to the configuration described above, the flow of air between the device accommodation case and the outside is performed through the second ventilation film, the air chamber, and the first ventilation film. Even if outside water is applied to the one film surface facing the outside, the first ventilation film can prevent the outside water from flowing into the air chamber side. Even if the oil in the device accommodation case adheres to the one film surface facing the inside of the device accommodation case, the second ventilation film can prevent the oil from flowing into the air chamber side. Therefore, in the ventilation apparatus of the configuration described above, it is possible to prevent the outside water and the oil from adhering to the film surfaces of the front and rear sides of each of the first ventilation film and the second ventilation film. Accordingly, when the configuration described above is employed, it is possible to prevent the outside water and the oil from adhering to the front and rear sides of the ventilation film and prevent ventilation properties of the ventilation film from being degraded.

The first ventilation film and the second ventilation film may be arranged at positions that do not overlap each other in a top view.

In this case, even if outside water is applied to the first ventilation film, and the outside water passes through the first ventilation film for some reason, the outside water that has passed through the first ventilation film does not drop onto an upper portion of the second ventilation film. Therefore, it is possible to prevent the outside water and the oil from adhering to the front and rear sides of the second ventilation film and prevent ventilation properties of the second ventilation film from being degraded.

An outside water capture portion having a bottom surface that is at a lower position than an arrangement position of each of the first ventilation film and the second ventilation film may be provided inside the air chamber.

In this case, when outside water is applied to the first ventilation film, and the outside water passes through the first ventilation film for some reason, the outside water flows into the outside water capture portion and remains. At this time, since the bottom surface of the outside water capture portion is at a lower position than the arrangement position of each of the first ventilation film and the second ventilation film, the outside water that remains in the outside water capture portion does not easily flow into the first ventilation film and the second ventilation film. Therefore, even when the outside water passes through the first ventilation film for some reason, it is possible to prevent the outside water and the oil from adhering to the front and rear sides of the first ventilation film and the second ventilation film.

The first ventilation film may be located at a higher position than the second ventilation film, and a vapor-liquid separation structure may be provided between the outside water capture portion and the second ventilation film.

In this case, even when outside water passes through the first ventilation film, and the outside water remains in the outside water capture portion, since the vapor-liquid separation structure is provided between the outside water capture portion and the second ventilation film, the outside water in the outside water capture portion does not easily flow into the second ventilation film. Therefore, it is possible to prevent the outside water and the oil from adhering to the front and rear sides of the second ventilation film.

The vapor-liquid separation structure may be constituted of a labyrinth pathway in which a passage from the outside water capture portion to the second ventilation film meanders in an upward-downward direction.

In this case, the inflow of the outside water that remains in the outside water capture portion into the second ventilation film is prevented by the meandering passage of the labyrinth pathway and a gravity force that acts on the outside water. Therefore, it is possible to further reliably prevent the outside water and the oil from adhering to the front and rear sides of the second ventilation film.

An outside water regulation wall that regulates an inflow of outside water toward the first ventilation film from a circumference outside of the first ventilation film may be arranged in a circumference region of a side that faces the outside of the first ventilation film.

In this case, since the outside water regulation wall is arranged in the circumference region on the side that faces the outside of the first ventilation film, it is possible to regulate the inflow of the outside water in a direction where the first ventilation film is present by the outside water regulation wall at the time of navigation of the marine vessel or the like. Therefore, when the present configuration is employed, it is possible to further reliably prevent the outside water from passing through the first ventilation film and entering the air chamber, and prevent the outside water and the oil from adhering to the front and rear sides of the second ventilation film.

An oil regulation wall that regulates an inflow of oil in the device accommodation case toward the second ventilation film from a circumference outside of the second ventilation film may be arranged in a circumference region of a side that faces the inside of the device accommodation case of the second ventilation film.

In this case, since the oil regulation wall is arranged in the circumference region on the side that faces the inside of the device accommodation case of the second ventilation film, it is possible to regulate the inflow of the oil in the device accommodation case in a direction where the second ventilation film is present by the oil regulation wall. Therefore, when the present configuration is employed, the oil in the device accommodation case does not easily adhere to the second ventilation film, and it is possible to further reliably prevent the outside water and the oil from adhering to the front and rear sides of the second ventilation film.

The first ventilation film may be arranged in an attitude in which the film surface is along a vertical direction or in an attitude inclined relative to a horizontal plane.

In this case, since the film surface of the first ventilation film becomes the attitude along the vertical direction or the attitude inclined relative to the horizontal plane, when outside water is applied to the film surface (the one film surface) of the first ventilation film, the outside water promptly flows downward without remaining on the first ventilation film. Therefore, when the outside water is seawater, it is possible to prevent the seawater that remains on the film surface of the first ventilation film from drying and adhering to the film surface of the first ventilation film as solid particles. Accordingly, when the present configuration is employed, it is possible to prevent ventilation performance of the first ventilation film from being degraded due to the adhesion of solid particles of seawater to the first ventilation film.

A marine vessel propulsion machine according to an aspect of the present invention includes: a propulsion mechanism that propels a marine vessel; a device accommodation case that accommodates at least part of the propulsion mechanism in the inside of the device accommodation case, at least part of the device accommodation case being submerged in outer water; and a ventilation apparatus that permits a flow of air between the inside of the device accommodation case and the outside, wherein the ventilation apparatus includes: a first ventilation film that permits passing of a gas, prevents passing of a liquid, and has one film surface facing the outside; a second ventilation film that permits passing of a gas, prevents passing of a liquid, and has one film surface facing the inside of the device accommodation case; and an air chamber which another film surface of each of the first ventilation film and the second ventilation film faces.

Effects of the Invention

According to the present invention, it is possible to prevent outside water and oil from adhering to the front and rear sides of the ventilation film and continuously maintain good ventilation performance.

EMBODIMENTS

Figure 1:
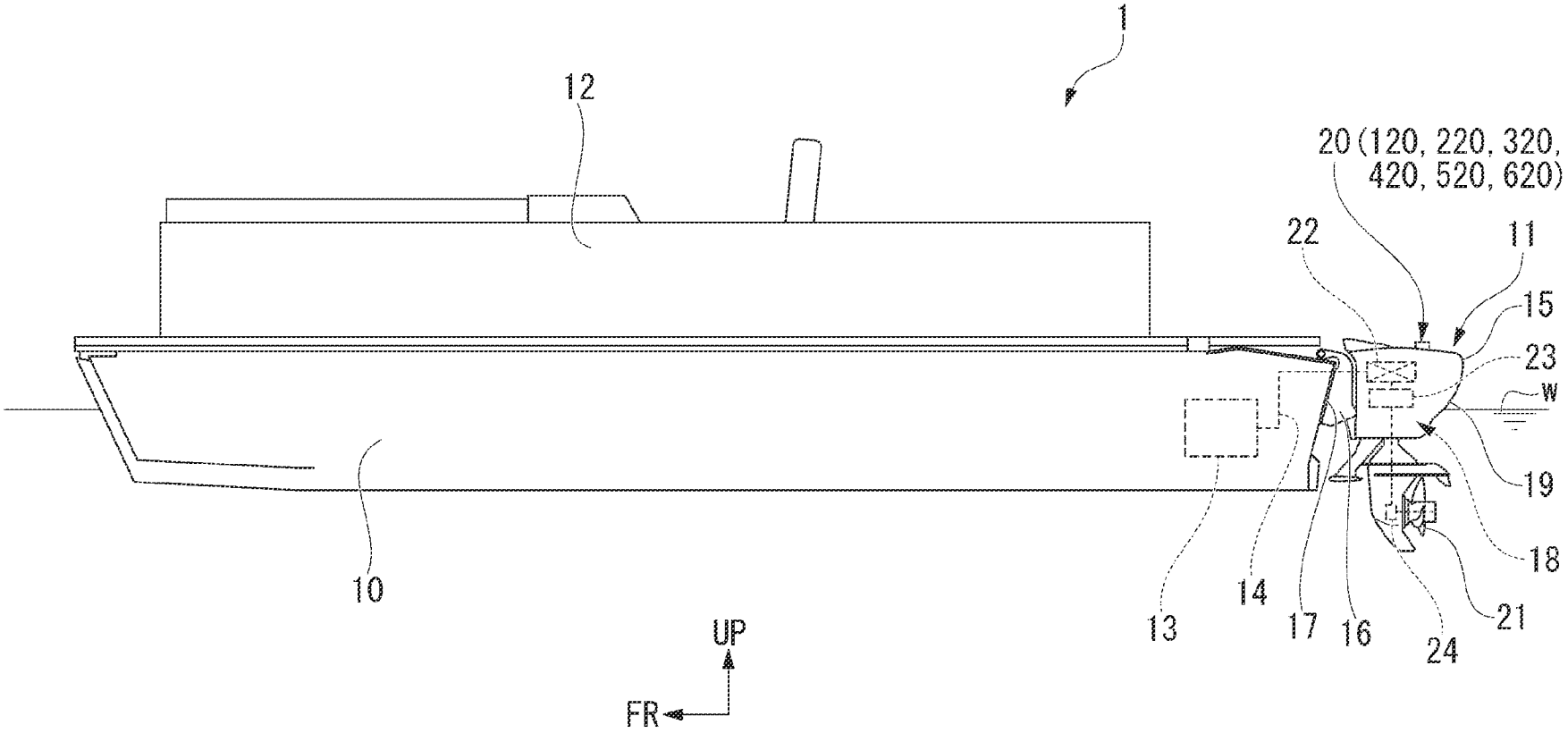
FIG. 1 is a side view of a marine vessel of an embodiment.

Hereinafter, embodiments of the present invention will be described with reference to the drawings.

In an appropriate position of the drawings, an arrow FR that indicates a forward side of a propulsion direction of a marine vessel propulsion machine and an arrow UP that indicates a vertically upward direction are shown. Further, in the embodiments described below, common portions are denoted by the same reference numerals, and redundant descriptions are partially omitted.

FIG. 1 is a side view of a marine vessel 1 of an embodiment when seen from a left side.

The marine vessel 1 includes a hull 10 and an outboard motor 11 that is provided on a rear portion of the hull 10. The outboard motor 11 is one form of a marine vessel propulsion machine, and in the present embodiment, the outboard motor 11 constitutes the marine vessel propulsion machine. The hull 10 includes a wheelhouse 12. A battery is provided on the hull 10. A DC cable 14 for supplying electric power of the battery 13 to the outboard motor 11 is wired between the battery 13 and the outboard motor 11. The battery 13 can be provided on the outboard motor 11.

The outboard motor 11 includes an outboard motor main body 15 and an attachment portion 16 for attaching the outboard motor main body 15 to the hull 10. The attachment portion 16 is fixed to a transom 17 at a rear portion of the hull 10. A tilt device (not shown) is provided on the attachment portion 16. The tilt device appropriately switches the outboard motor main body 15 between a first attitude at the time of normal propulsion and a second attitude in which a rear portion of the outboard motor main body 15 is lifted further upward than the first attitude by an operation of an actuator (not shown). In the first attitude, a shaft of a screw 21 described later becomes substantially horizontal in outside water w (water such as seawater or river water). In the second attitude, a rear side of the outboard motor main body 15 is lifted upward (tilted up), and the shaft of the screw 21 is inclined upward.

The outboard motor main body 15 includes a propulsion mechanism 18 that propels the marine vessel 1, a device accommodation case 19 that accommodates a main part (at least a portion) of the propulsion mechanism 18 within the device accommodation case 19, and a ventilation apparatus 20 that permits the flow of a gas (air) between the outside and the inside of the device accommodation case 19. The propulsion mechanism 18 is constituted of a screw 21 (a propulsion generation portion) arranged outside a lower region of the device accommodation case 19 and an electric motor 22, a speed reduction machine 23, a bevel gear 24, and the like that are accommodated within the device accommodation case 19. A control portion (not shown) for controlling driving of the electric motor 22 is also accommodated within the device accommodation case 19. In the present embodiment, the electric motor 22 is a drive source for driving the screw 21.

However, the drive source that drives the propulsion generation portion (screw 21) is not limited to the electric motor 22. An internal combustion engine or a hybrid drive portion that uses an internal combustion engine and an electric motor instead of the electric motor 22 can be employed as the drive source that drives the propulsion generation portion (screw 21). Further, the propulsion generation portion is not limited to the screw 21. The propulsion generation portion may be, for example, a portion of another propulsion method such as a water jet method or an outer wheel method.

The ventilation apparatus 20 is provided on an upper portion of the device accommodation case 19 at a position that is not submerged in the outside water w. The ventilation apparatus 20 is an apparatus that prevents the inflow of the outside water w from the outside to the inside of the device accommodation case 19 and permits the flow of air (gas) between the outside and the inside of the device accommodation case 19.

Hereinafter, various embodiments of ventilation apparatuses 20 (120, 220, 320, 420, 520, 620) will be described.

First Embodiment

Figure 2:
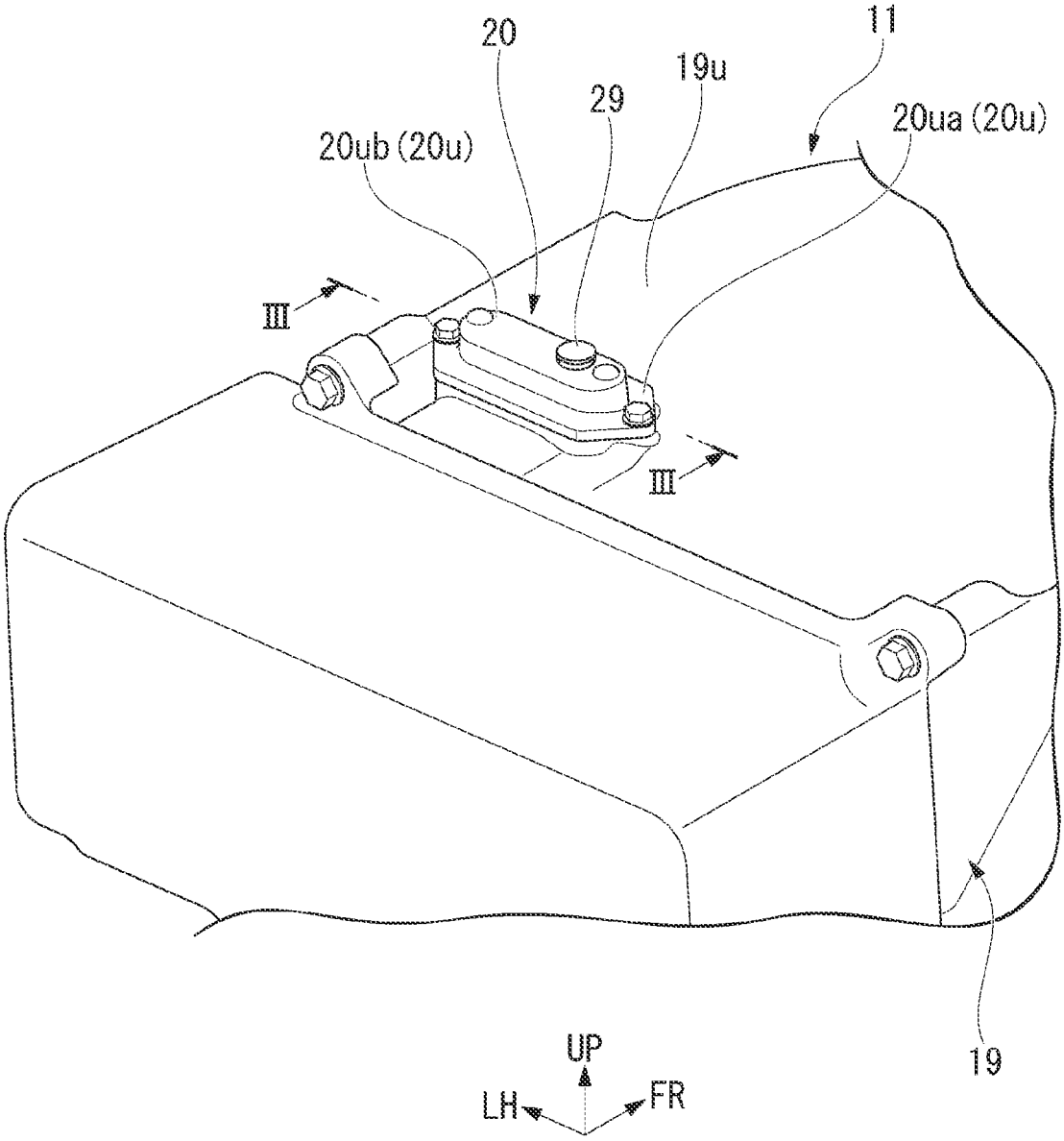
FIG. 2 is a perspective view of an upper portion of an outboard motor (marine vessel propulsion machine) of a first embodiment.
Figure 3:
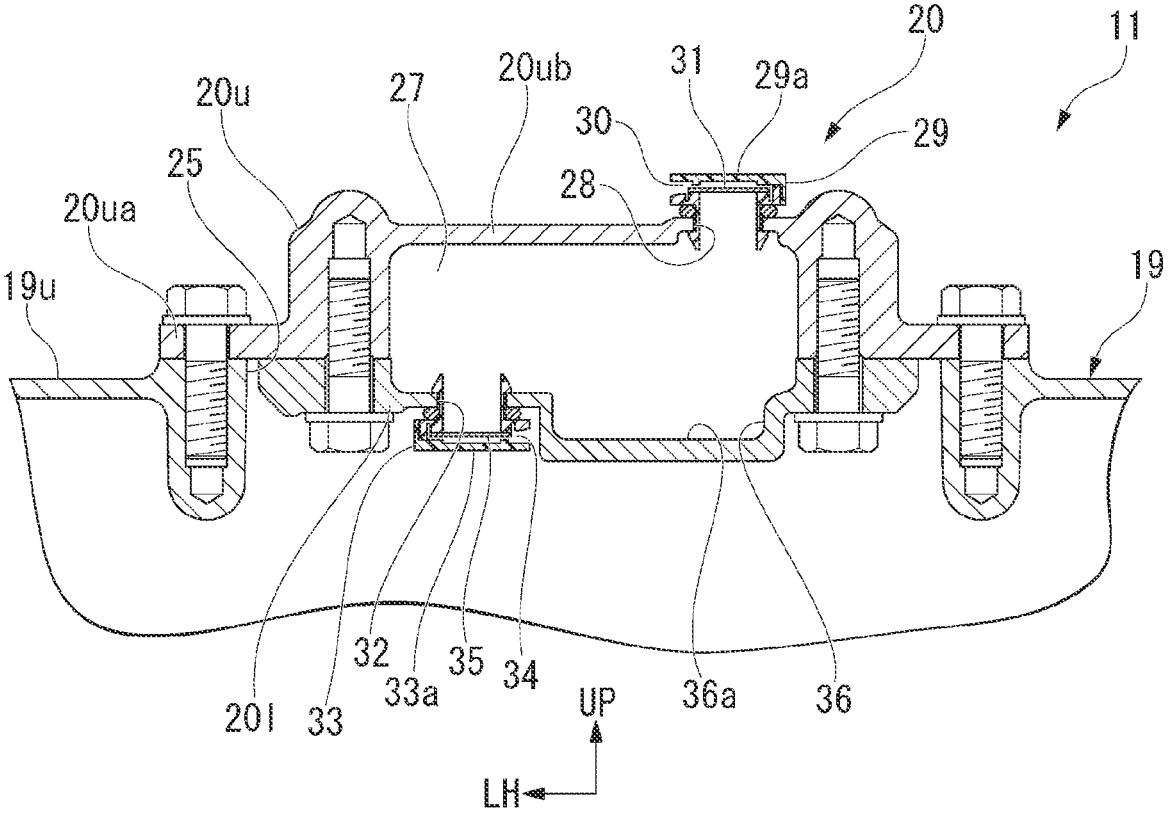
FIG. 3 is a cross-sectional view along a III-III line of FIG. 2 of a ventilation apparatus of the first embodiment.

FIG. 2 is a perspective view of an upper portion of the outboard motor 11 of the present embodiment. FIG. 3 is a cross-sectional view along a III-III line of FIG. 2 of the ventilation apparatus 20 of the present embodiment.

In the present embodiment, the ventilation apparatus 20 is provided on an upper wall portion close to a rear portion of the device accommodation case 19. The ventilation apparatus 20 is fastened and fixed to a circumference edge portion of a through-hole 25 formed on an upper wall 19*u* of the device accommodation case 19 so as to close the through-hole 25 as shown in FIG. 3. The ventilation apparatus 20 includes an upper member 20*u* that opens downward and has a hat shape in a cross-section and a lower member 201 that is joined to a lower surface of the upper member 20*u* so as to close the downward opening of the upper member 20*u*. The upper member 20*u* and the lower member 201 are fastened and fixed to each other. The upper member 20*u* includes a circumference edge flange 20*ua* that has an annular shape and is in contact with an upper surface of the upper wall 19*u* of the device accommodation case 19 and an expansion portion 20*ub* that expands upward from an inner circumference edge portion of the circumference edge flange 20*ua*. A space portion is formed between the expansion portion 20*ub* and the lower member 201, and the space portion constitutes an air chamber 27 in the present embodiment.

A first ventilation port 28 is formed on an upper wall of the expansion portion 20*ub* of the upper member 20*u*. The first ventilation port 28 causes the inside of the air chamber 27 to communicate with the outside of the outboard motor 11. A first film attachment cap 29 is attached to the first ventilation port 28. The first film attachment cap 29 is a cap member that is hermetically attached to the first ventilation port 28, and a minute pathway 30 that causes the inside and the outside of the air chamber 27 to communicate with each other is provided on the first film attachment cap 29. Further, a first ventilation film 31 is attached to the first film attachment cap 29 so as to block the middle of the pathway 30. The first ventilation film 31 is a film that permits passing of a gas and prevents passing of a liquid. The first ventilation film 31 is constituted of a resin porous film, for example, made of polytetrafluoroethylene (PTFE).

In the first ventilation film 31, one film surface (film surface on an upper side in FIG. 3) faces the outside through the pathway 30 and the other film surface (film surface on a lower side in FIG. 3) faces the inside of the air chamber 27. A cover wall 29*a* that covers an upper side of the first ventilation film 31 across a minute gap is provided on the first film attachment cap 29. The cover wall 29*a* prevents the outside water from being directly applied from the upper side of the first ventilation film 31.

A second ventilation port 32 is formed on the lower member 201. The second ventilation port 32 causes the inside of the device accommodation case 19 to communicate with the inside of the air chamber 27. A second film attachment cap 33 is attached to the second ventilation port 30. The second film attachment cap 33 is a cap member that is hermetically attached to the second ventilation port 32, and a minute pathway 34 that causes the inside of the device accommodation case 19 and the inside of the air chamber 27 to communicate with each other is provided on the second film attachment cap 33. A second ventilation film 35 is attached to the second film attachment cap 33 so as to block the middle of the pathway 34. The second ventilation film 35 is a film that permits passing of a gas and prevents passing of a liquid. The second ventilation film 35 is constituted of a resin porous film, for example, made of polytetrafluoroethylene (PTFE) or the like similarly to the first ventilation film 31.

In the second ventilation film 35, one film surface (film surface on a lower side in FIG. 3) faces the inside of the device accommodation case 19 through the pathway 34 and the other film surface (film surface on an upper side in FIG. 3) faces the inside of the air chamber 27. A cover wall 33*a* that covers a lower side of the second ventilation film 35 across a minute gap is provided on the second film attachment cap 33. The cover wall 33*a* prevents oil for device lubrication or device cooling in the device accommodation case 19 from being directly applied from the lower side of the second ventilation film 35.

The first ventilation film 31 (first film attachment cap 29) provided on the upper member 20*u* and the second ventilation film 35 (second film attachment cap 33) provided on the lower member 201 are arranged at positions that do not overlap each other in a top view. That is, the second ventilation film 35 is provided on the lower member 201 so as to be displaced from a position immediately below the first ventilation film 31. Further, an outside water capture portion 36 that is recessed downward relative to the arrangement portion of the second ventilation film 35 is formed at a position that faces the inside of the air chamber 27 of the lower member 201. A bottom surface 36*a* of the outside water capture portion 36 is at a lower position than an arrangement position of each of the first ventilation film 31 and the second ventilation film 35. When outside water passes through the first ventilation film 31 and flows into the air chamber 27 for some reason, the outside water capture portion 36 captures the outside water in the air chamber 27. Since a bottom surface 36*a* of the outside water capture portion 36 is at a lower position than the arrangement position of the second ventilation film 35, the outside water captured by the outside water capture portion 36 does not easily adhere to the second ventilation film 35.

As described above, in the ventilation apparatus 20 of the present embodiment, the first ventilation film 31 and the second ventilation film 35 are constituted of a film material that permits passing of a gas and prevents passing of a liquid. The first ventilation film 31 is attached to the upper member 20*u* such that one film surface (upper surface) faces the outside and the other film surface (lower surface) faces the air chamber 27. The second ventilation film 35 is attached to the lower member 201 such that one film surface (lower surface) faces the inside of the device accommodation case 19 and the other film surface (upper surface) faces the inside of the air chamber 27. Therefore, the flow of air between the device accommodation case 19 and the outside through the second ventilation film 35, the air chamber 27, and the first ventilation film 31 is performed. Therefore, it is possible to smoothly perform air ventilation in the device accommodation case 19 or the flow of air (inflation and deflation of the internal air) accompanied by an increase or decrease in the temperature in the device accommodation case 19 through the ventilation apparatus 20.

On the other hand, in the ventilation apparatus 20 of the present embodiment, even when outside water w is applied to the upper member 20*u* and the outside water w flows into the upper surface side of the first ventilation film 31 through the pathway 30 of the first film attachment cap 29, by the function of the first ventilation film 31, it is possible to prevent the outside water w from flowing into the air chamber side. Further, even when the outside water w passes through the first ventilation film 31 for some reason and flows into the air chamber, the outside water w evaporates over time and is discharged to the outside through the first ventilation film 31.

Since the one film surface (lower surface) of the second ventilation film 35 faces the inside of the device accommodation case 19, the oil for lubrication or cooling of a device in the device accommodation case 19 may adhere to the one film surface (lower surface) of the second ventilation film 35. However, in the ventilation apparatus 20 of the present embodiment, the inflow of the outside water w from the outside to the air chamber 27 is prevented by the first ventilation film 31. Therefore, the ventilation apparatus 20 can prevent the outside water w and the oil from simultaneously adhering to the front and rear sides of the second ventilation film 35. Accordingly, it is possible to prevent the outside water w and the oil from adhering to the front and rear sides of each of the first ventilation film 31 and the second ventilation film 35 and prevent ventilation properties of the ventilation film from being degraded.

Accordingly, when the ventilation apparatus 20 of the present embodiment is employed, it is possible to prevent the outside water w and the oil from adhering to the front and rear sides of the ventilation film and to continuously maintain good ventilation performance.

Further, in the ventilation apparatus 20 of the present embodiment, the first ventilation film 31 and the second ventilation film 35 are arranged at positions that do not overlap each other in a top view. Therefore, even if outside water w is applied to the upper surface side of the first ventilation film 31, and the outside water w passes through the first ventilation film 31 for some reason, the outside water w that has passed through the first ventilation film 31 does not drop onto the upper side of the second ventilation film 35. Accordingly, in the ventilation apparatus 20 of the present embodiment, even when the outside water w passes through the first ventilation film 31, the outside water w does not easily flow to the upper surface side of the second ventilation film 35, and therefore, it is possible to prevent the outside water w and the oil from adhering to the front and rear sides of the second ventilation film 35 and prevent ventilation properties of the second ventilation film 35 from being degraded.

Further, in the ventilation apparatus 20 of the present embodiment, the outside water capture portion 36 is provided in the air chamber 27, and the bottom surface 36*a* of the outside water capture portion 36 is lower than the arrangement position of each of the first ventilation film 31 and the second ventilation film 35. Therefore, when outside water w is applied to the first ventilation film 31, and the outside water w passes through the first ventilation film 31 for some reason, it is possible to capture the outside water w by the outside water capture portion 36. At this time, since the bottom surface 36*a* of the outside water capture portion 36 is lower than the arrangement position of each of the first ventilation film 31 and the second ventilation film 35, the outside water w that remains in the outside water capture portion 36 does not easily flow to the upper surface of the second ventilation film 35. Accordingly, when the present configuration is employed, even when the outside water w passes through the first ventilation film for some reason, it is possible to further prevent the outside water w and the oil from adhering to the front and rear sides of the second ventilation film 35.

Second Embodiment

Figure 4:
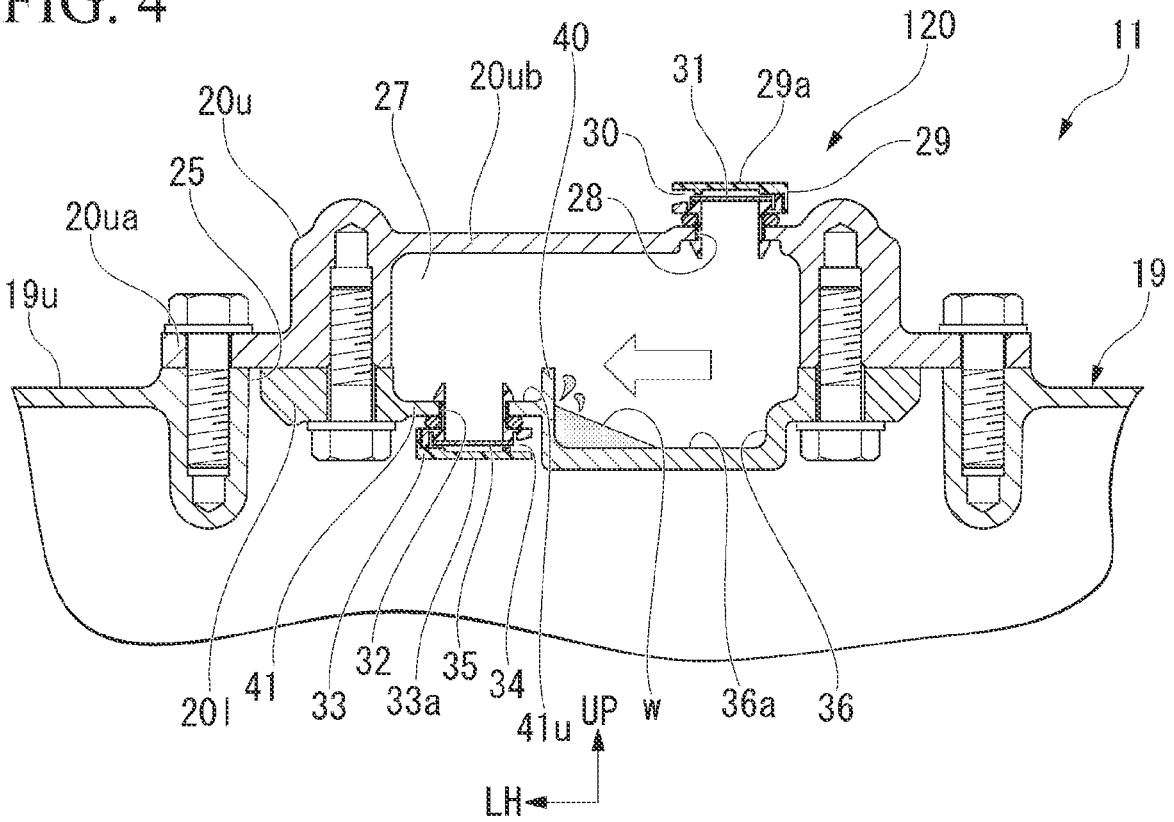
FIG. 4 is a cross-sectional view similar to FIG. 3 of a ventilation apparatus of a second embodiment.

FIG. 4 is a cross-sectional view, similar to FIG. 3 of the first embodiment, of a ventilation apparatus 120 of the present embodiment.

The ventilation apparatus 120 of the present embodiment has a basic configuration similar to that of the first embodiment but differs from the first embodiment in that a partition wall 40 is provided to protrude between the arrangement positions of the outside water capture portion 36 and the second ventilation film 35. The partition wall 40 is arranged on an outer circumference edge section of the outside water capture portion 36 at a boundary portion with an arrangement wall 41 on which the second ventilation film 35 (first film attachment cap 29) is arranged. The partition wall 40 protrudes further upward than an upper surface 41*u* of the arrangement wall 41.

In the present embodiment, the partition wall 40 constitutes a vapor-liquid separation structure.

Since the ventilation apparatus 120 of the present embodiment has a basic configuration similar to that of the first embodiment, it is possible to obtain effects similar to those of the first embodiment described above.

Other embodiments described below include a basic configuration similar to that of the first embodiment. Therefore, iterative description is omitted, but in the other embodiments described below, it is possible to obtain basic effects similar to those of the first embodiment.

Further, in the ventilation apparatus 120 of the present embodiment, since the partition wall 40 is provided to protrude between the arrangement positions of the outside water capture portion 36 and the second ventilation film 35, even when the outer water w remains in the outside water capture portion 36 in the air chamber 27, the outer water w does not easily flow to the second ventilation film 35 portion. Accordingly, when the present configuration is employed, even when the outside water w remains in the outside water capture portion 36 in the air chamber 27 for some reason, it is possible to further prevent the outside water w and the oil from adhering to the front and rear sides of the second ventilation film 35.

Third Embodiment

Figure 5:
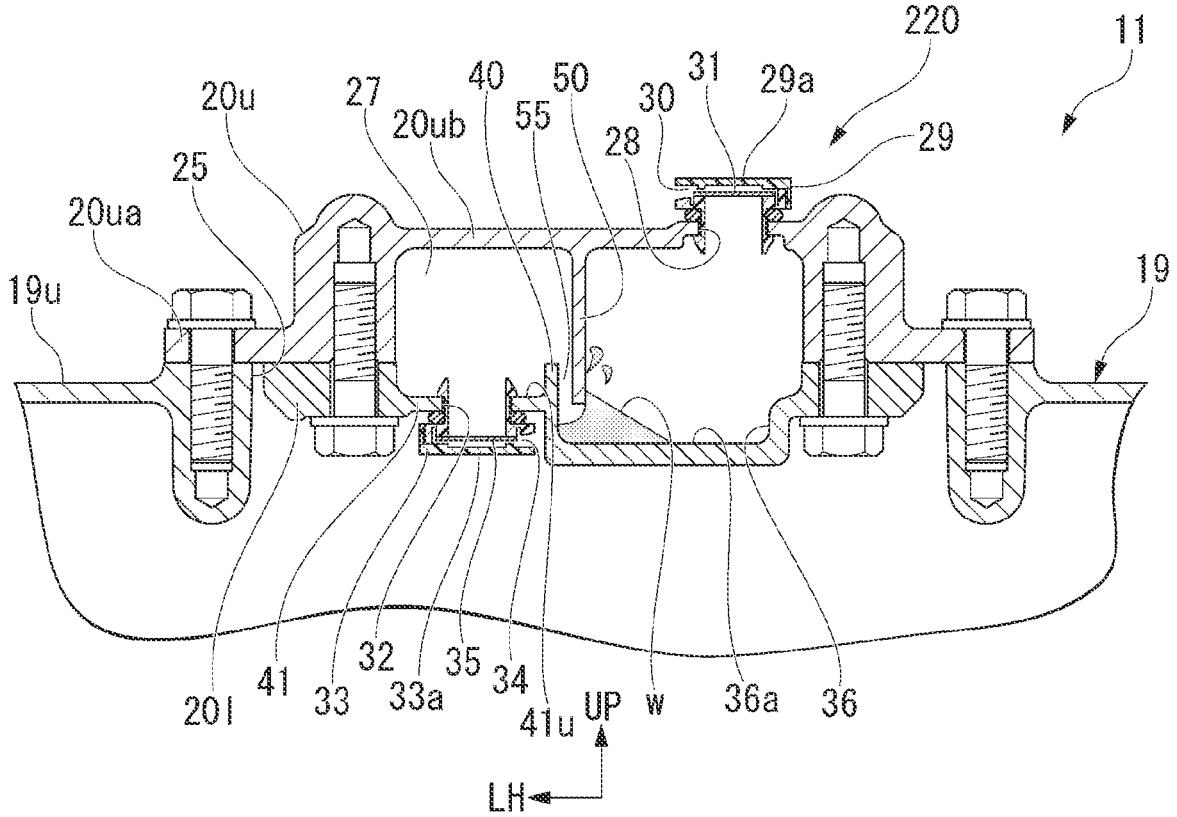
FIG. 5 is a cross-sectional view similar to FIG. 3 of a ventilation apparatus of a third embodiment.

FIG. 5 is a cross-sectional view, similar to FIG. 3 of the first embodiment, of a ventilation apparatus 220 of the present embodiment.

The ventilation apparatus 220 of the present embodiment has the following configuration added to the structure of the ventilation apparatus 120 of the second embodiment.

A downward extension wall 50 that extends vertically downward is provided to protrude on a lower surface of the upper wall of the upper member 20*u*. A lower edge portion of the downward extension wall 50 extends to a position that overlaps the side wall of the outside water capture portion 36 and the partition wall 40 in an upward-downward direction. Further, the lower edge portion of the downward extension wall 50 faces a side surface of the partition wall 40 on the outside water capture portion 36 side across a gap. The downward extension wall 50 and the partition wall 40 constitute a labyrinth pathway 55 that meanders in the upward-downward direction. The labyrinth pathway 55 constitutes part of a passage from the outside water capture portion 36 to the second ventilation film 35.

In the present embodiment, the labyrinth pathway 55 constitutes a vapor-liquid separation structure.

In the ventilation apparatus 220 of the present embodiment, the labyrinth pathway 55 that meanders in the upward-downward direction is formed of the partition wall 40 and the downward extension wall 50, and the labyrinth pathway 55 constitutes the passage from the outside water capture portion 36 to the second ventilation film 35. Therefore, the inflow of the outside water w that remains in the outside water capture portion 36 into the second ventilation film 35 is prevented by the meandering passage of the labyrinth pathway 55 and a gravity force that acts on the outside water w. Accordingly, when the present configuration is employed, it is possible to further reliably prevent the outside water w and the oil from adhering to the front and rear sides of the second ventilation film 35.

Fourth Embodiment

Figure 6:
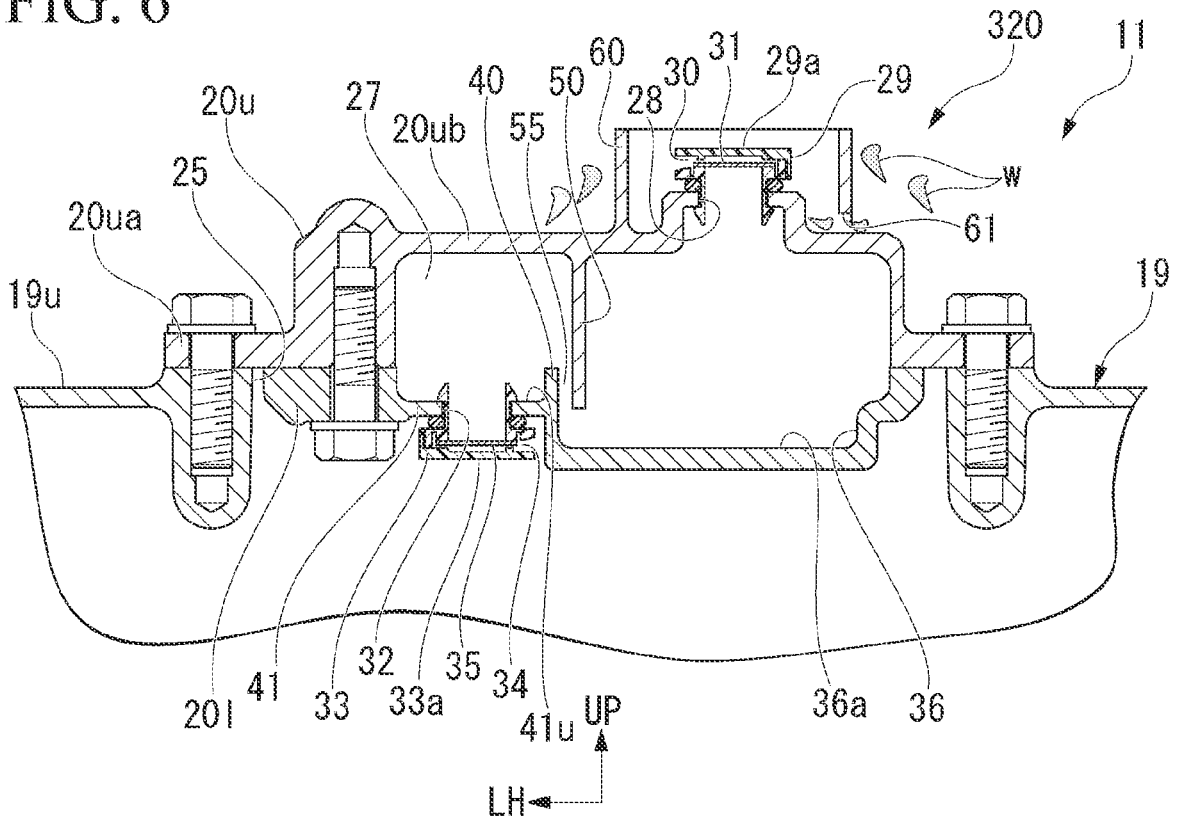
FIG. 6 is a cross-sectional view similar to FIG. 3 of a ventilation apparatus of a fourth embodiment.

FIG. 6 is a cross-sectional view, similar to FIG. 3 of the first embodiment, of a ventilation apparatus 320 of the present embodiment.

The ventilation apparatus 320 of the present embodiment further has the following configuration added to the structure of the ventilation apparatus 220 of the third embodiment.

An outside water regulation wall 60 having a cylindrical shape and surrounding the circumference region of the first film attachment cap 29 (first ventilation film 31) is provided to protrude on an upper surface of the upper wall of the upper member 20*u*. The outside water regulation wall 60 protrudes upward from the upper wall of the upper member 20*u* and regulates the inflow of the outside water w toward the first ventilation film 31 from the circumference outside of the first ventilation film 31. The outside water regulation wall 60 protrudes further upward than the upper surface of the first film attachment cap 29. Further, an outside water discharge hole 61 for discharging, when outside water w enters the inside of the outside water regulation wall 60, the entering outside water to the outside is formed on a lower end of the outside water regulation wall 60.

The shape of the outside water regulation wall 60 is not necessarily a cylindrical shape and may be another shape such as a triangular cylinder shape or a square cylinder shape. Further, the outside water regulation wall 60 may not have a cylindrical shape and may be formed of a plurality of plate walls provided to protrude so as to surround the circumference region of the first film attachment cap 29 (first ventilation film 31).

In the ventilation apparatus 220 of the present embodiment, since the outside water regulation wall 60 is arranged in the circumference region on the outside of the first ventilation film 31, it is possible to regulate the inflow of the outside water w in a direction where the first ventilation film 31 is present by the outside water regulation wall 60 at the time of navigation of the marine vessel or the like. Accordingly, when the present configuration is employed, it is possible to further reliably prevent the outside water w from passing through the first ventilation film 31 and entering the air chamber 27, and prevent the outside water w and the oil from adhering to the front and rear sides of the second ventilation film 35.

Fifth Embodiment

Figure 7:
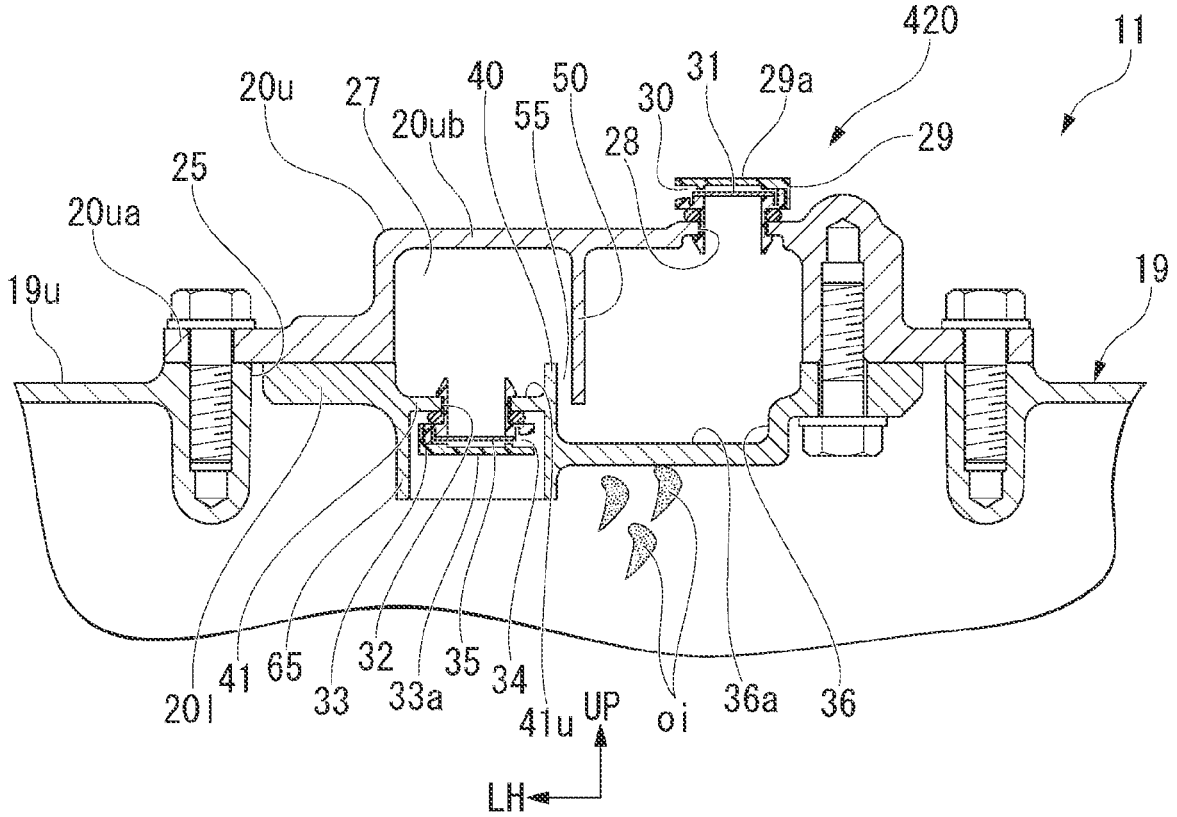
FIG. 7 is a cross-sectional view similar to FIG. 3 of a ventilation apparatus of a fifth embodiment.

FIG. 7 is a cross-sectional view, similar to FIG. 3 of the first embodiment, of a ventilation apparatus 420 of the present embodiment.

The ventilation apparatus 420 of the present embodiment further has the following configuration added to the structure of the ventilation apparatus 220 of the third embodiment.

An oil regulation wall 65 having a cylindrical shape and surrounding the circumference region of the second film attachment cap 33 (second ventilation film 35) is provided to protrude on a lower surface of the arrangement wall 41 of the lower member 201. The oil regulation wall 65 protrudes downward from the arrangement wall 41 of the lower member 201 and regulates the inflow of oil oi in the device accommodation case 19 toward the second ventilation film 35 from the circumference outside of the second ventilation film 35. The oil regulation wall 65 protrudes further downward than the lower surface of the second film attachment cap 33.

The shape of the oil regulation wall 65 is not necessarily a cylindrical shape and may be another shape such as a triangular cylinder shape or a square cylinder shape. Further, the oil regulation wall 65 may not have a cylindrical shape and may be formed of a plurality of plate walls provided to protrude so as to surround the circumference region of the second film attachment cap 33 (second ventilation film 35).

In the ventilation apparatus 220 of the present embodiment, since the oil regulation wall 65 is arranged in the circumference region on the inside of the device accommodation case 19 of the second ventilation film 35, it is possible to regulate the inflow of the oil oi in the device accommodation case 19 in a direction where the second ventilation film 35 is present by the oil regulation wall 65. Accordingly, when the present configuration is employed, the oil oi in the device accommodation case 19 does not easily adhere to the second ventilation film 35, and it is possible to further reliably prevent the outside water and the oil oi from adhering to the front and rear sides of the second ventilation film 55.

In the structure of the present embodiment, the outside water regulation wall 60 of the fourth embodiment may be further added to the upper wall of the upper member 20*u*.

Sixth Embodiment

Figure 8:
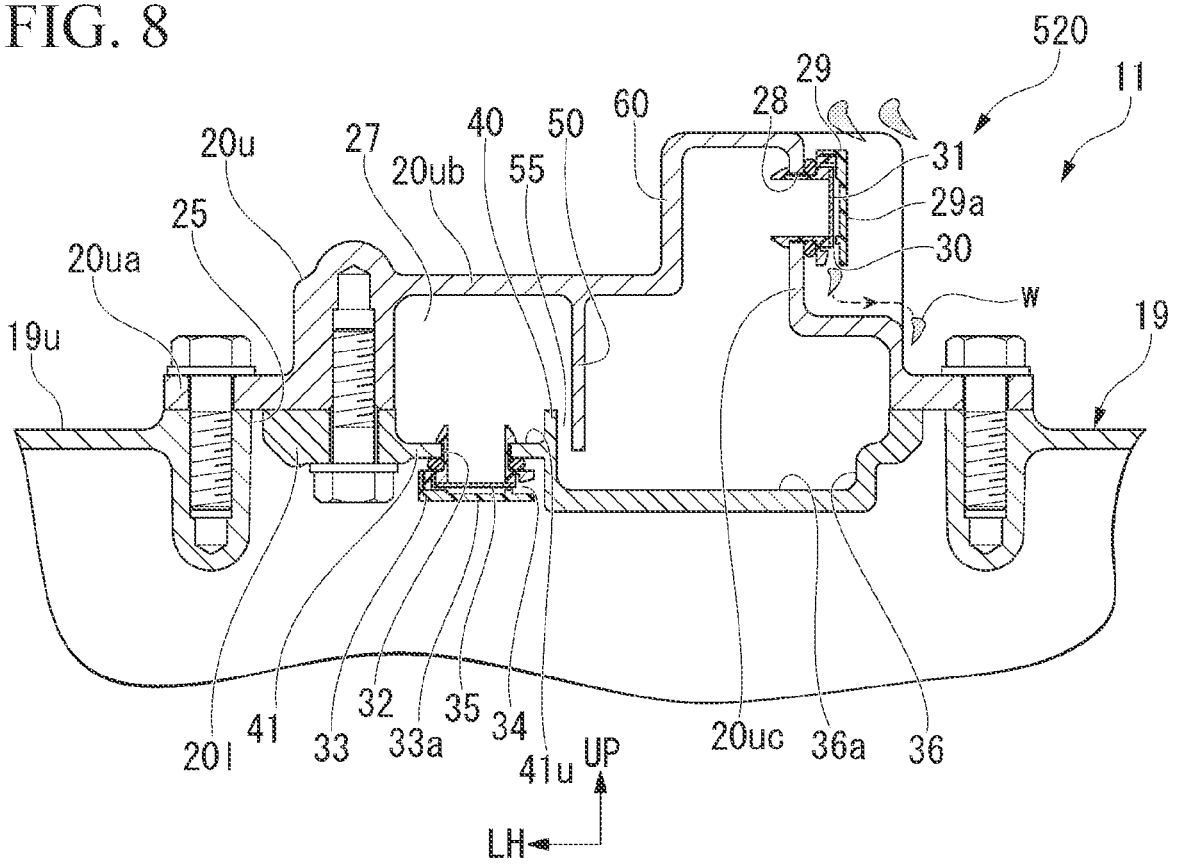
FIG. 8 is a cross-sectional view similar to FIG. 3 of a ventilation apparatus of a sixth embodiment.

FIG. 8 is a cross-sectional view, similar to FIG. 3 of the first embodiment, of a ventilation apparatus 520 of the present embodiment.

The ventilation apparatus 520 of the present embodiment differs from the ventilation apparatus 20 of the first embodiment in the following point.

In the ventilation apparatus 20 of the first embodiment shown in FIG. 3, the first ventilation port 28 is provided on the upper wall of the expansion portion 20*ub* of the upper member 20*u*, and the first film attachment cap 29 (first ventilation film 31) is attached to the first ventilation port 28. On the other hand, in the ventilation apparatus 520 of the present embodiment, a first ventilation port 28 is provided on a side wall 20*uc* of the expansion portion 20*ub* of the upper member 20*u*, and the first film attachment cap 29 (first ventilation film 31) is attached to the first ventilation port 28. That is, in the case of the ventilation apparatus 520 of the present embodiment, the first ventilation film 31 in the first film attachment cap 29 is provided in an attitude in which the film surface is along the vertical direction.

In the ventilation apparatus 520 of the present embodiment, since the film surface of the first ventilation film 31 is in the attitude along the vertical direction, when outside water w is applied to an outer film surface (one film surface) of the first ventilation film 31, the outside water w promptly flows downward without remaining on the first ventilation film 31. Therefore, even when the outside water w is seawater, it is possible to prevent the seawater that remains on the film surface of the first ventilation film 31 from drying and adhering to the film surface of the first ventilation film 31 as solid particles. Accordingly, when the ventilation apparatus 520 of the present configuration is employed, it is possible to prevent ventilation performance of the first ventilation film 31 from being degraded due to the adhesion of solid particles of the seawater to the first ventilation film 31.

In the present embodiment, the first ventilation film 31 is provided such that the film surface of the first ventilation film 31 is in the attitude along the vertical direction; however, the first ventilation film 31 may be provided in an attitude inclined relative to a horizontal plane. In this case, when the outside water w is applied to the outer film surface (one film surface) of the first ventilation film 31, the outside water w can smoothly flow downward. Accordingly, it is possible to prevent the seawater that remains on the film surface of the first ventilation film 31 from drying and adhering to the film surface of the first ventilation film 31 as solid particles.

Seventh Embodiment

Figure 9:
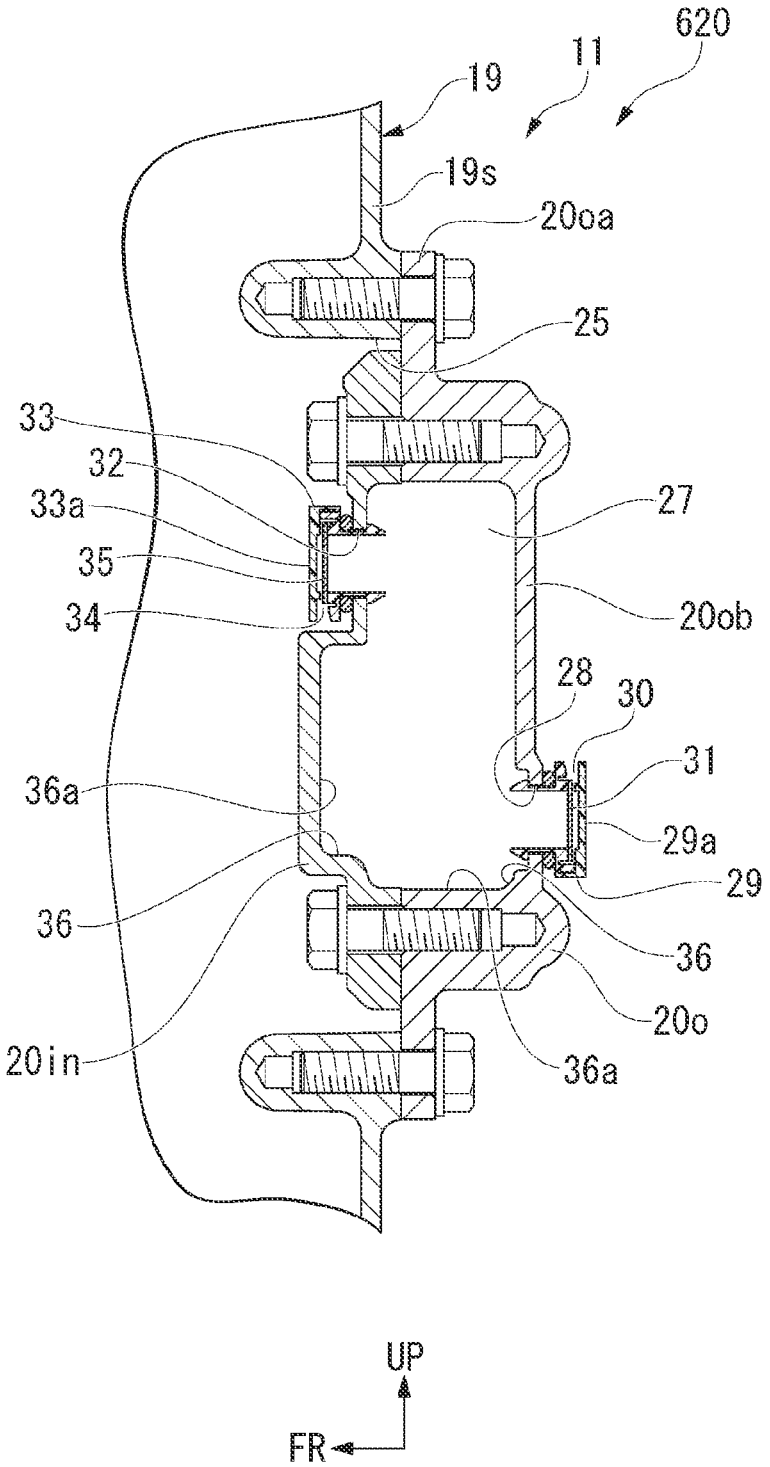
FIG. 9 is a cross-sectional view similar to FIG. 3 of a ventilation apparatus of a seventh embodiment.

FIG. 9 is a cross-sectional view, similar to FIG. 3 of the first embodiment, of a ventilation apparatus 620 of the present embodiment.

The ventilation apparatus 620 of the present embodiment differs from the ventilation apparatus 20 of the first embodiment in the following point.

The ventilation apparatus 20 of the first embodiment shown in FIG. 3 is attached to the upper wall 19*u* of the device accommodation case 19. On the other hand, the ventilation apparatus 620 of the present embodiment is attached to a side wall 19*s* of the device accommodation case 19. A through-hole 25 is provided on the side wall 19*s* of the device accommodation case 19. The ventilation apparatus 620 is fixed to the side wall 19*s* of the device accommodation case 19 so as to close the through-hole 25.

The ventilation apparatus 620 includes an outer member 20*o* that faces the outside of the device accommodation case 19 and an inner member 20*in* that faces the inside of the device accommodation case 19. The outer member 20*o* has a circumference edge flange 20*oa* and an expansion portion 20*ob* that expands outward relative to the circumference edge flange 20*oa*. The outer member 20*o* is fastened and fixed to the inner member 20*in* at the circumference edge flange 20*oa* portion. An air chamber 27 is formed between the outer member 20*o* and the inner member 20*in*.

A first ventilation port 28 is formed on a side wall of the expansion portion 20*ob* of the outer member 20*o*. A first film attachment cap 29 is attached to the first ventilation port 28. The first film attachment cap 29 has the same configuration as that of the first embodiment and similarly includes a pathway 30 and a first ventilation film 31. In the first ventilation film 31, similarly to that of the first embodiment, one film surface faces the outside, and the other film surface faces the inside of the air chamber 27.

A second ventilation port 32 is formed on a side wall of the inner member 20*in*. A second film attachment cap 33 is attached to the second ventilation port 32. The second film attachment cap 33 has the same configuration as that of the first embodiment and includes a pathway 34 and a second ventilation film 35. In the second ventilation film 35, similarly to that of the first embodiment, one film surface faces the inside of the device accommodation case 19, and the other film surface faces the inside of the air chamber 27. Further, in the case of the present embodiment, the second ventilation film 35 is arranged at a higher position than the first ventilation film 31.

Further, the outside water capture portion 36 that is recessed downward is provided on a bottom portion of the air chamber 27 formed of the outer member 20*o* and the inner member 20*in*. The bottom surface 36*a* of the outside water capture portion 36 is at a lower position than the arrangement position of each of the first ventilation film 31 and the second ventilation film 35. Therefore, when the outside water w passes through the first ventilation film 31 and flows into the air chamber 27 for some reason, the outside water w is captured by the outside water capture portion 36 at the bottom portion of the air chamber 27.

The ventilation apparatus 620 of the present embodiment has a basic configuration substantially similar to that of the first embodiment although the orientation of the arrangement with respect to the device accommodation case 19 differs. Therefore, it is possible to obtain basic effects substantially similar to the first embodiment described above.

The outside water regulation wall 60 of the fourth embodiment and the oil regulation wall 65 of the fifth embodiment can be added to the ventilation apparatus 620 of the present embodiment. In this case, it is possible to obtain effects similar to those described in the fourth embodiment and the fifth embodiment.

Further, in a state where the ventilation apparatus 620 of the present embodiment is attached to the device accommodation case 19, both the first ventilation film 31 and the second ventilation film 35 are in the attitude along the vertical direction. Therefore, when the outside water w is applied to the first ventilation film 31, the outside water w can promptly flow downward, and when the oil in the device accommodation case 19 is applied to the second ventilation film 35, the oil can promptly flow downward. Accordingly, when the present configuration is employed, it is possible to promptly remove adhesion of the outside water w and the oil onto the first ventilation film 31 and the second ventilation film 35 and maintain good ventilation properties of air (gas).

Further, in the ventilation apparatus 620 of the present embodiment, the first ventilation film 31 that faces the inside of the device accommodation case 19 is arranged at a higher position than the second ventilation film 35 that faces the outside. Therefore, even when the outside water w passes through the first ventilation film 31 and flows into the air chamber 27 for some reason, the outside water w does not easily scatter in the direction of the second ventilation film 35. Further, even when the outside water w remains in the outside water capture portion 36, the separation distance in the upward-downward direction from the outside water capture portion 36 to the second ventilation film 35 is sufficiently ensured, and therefore, the outside water in the outside water capture portion 36 does not easily adhere to the second ventilation film 35.

Accordingly, when the present configuration is employed, it is possible to further prevent the outside water w and the oil from adhering to the front and rear sides of the second ventilation film 35.

The present invention is not limited to the embodiments described above, and various design changes can be made without departing from the scope of the invention. For example, in the case of the above embodiments, the marine vessel propulsion machine is an outboard motor; however, the marine vessel propulsion machine is not limited to the outboard motor. The marine vessel propulsion machine may be an inboard motor, an inboard-outdrive motor, or the like.

DESCRIPTION OF REFERENCE NUMERALS

11 Outboard motor (marine vessel propulsion machine)
18 Propulsion mechanism
19 Device accommodation case
20, 120, 220, 320, 420, 520, 620 Ventilation apparatus
27 Air chamber
31 First ventilation film
35 Second ventilation film
36 Outside water capture portion
40 Partition wall (vapor-liquid separation structure)
55 Labyrinth pathway 55 (vapor-liquid separation structure)
60 Outside water regulation wall
65 Oil regulation wall

What is claimed is:

1. A marine vessel propulsion machine ventilation apparatus, comprising:

a first ventilation film that permits passing of a gas, prevents passing of a liquid, and has a first film surface which is one side of film surface facing an outside;

a second ventilation film that permits passing of a gas, prevents passing of a liquid, and has a second film surface which is one side of film surface facing an inside of a device accommodation case; and an air chamber which a third film surface which is an other side of film surface of the first ventilation film and a fourth film surface which is an other side of film surface of the second ventilation film face.

2. The marine vessel propulsion machine ventilation apparatus according to claim 1, wherein the first ventilation film and the second ventilation film are arranged at positions that do not overlap each other in a top view.

3. The marine vessel propulsion machine ventilation apparatus according to claim 1, wherein an outside water capture portion having a bottom surface that is at a lower position than an arrangement position of each of the first ventilation film and the second ventilation film is provided inside the air chamber.

4. The marine vessel propulsion machine ventilation apparatus according to claim 3, wherein the first ventilation film is located at a higher position than the second ventilation film, and a vapor-liquid separation structure is provided between the outside water capture portion and the second ventilation film.

5. The marine vessel propulsion machine ventilation apparatus according to claim 4, wherein the vapor-liquid separation structure is constituted of a labyrinth pathway in which a passage from the outside water capture portion to the second ventilation film meanders in an upward-downward direction.

6. The marine vessel propulsion machine ventilation apparatus according to claim 1, wherein an outside water regulation wall that regulates an inflow of an outside water toward the first ventilation film from a circumference outside of the first ventilation film is arranged in a circumference region of a side that faces the outside of the first ventilation film.

7. The marine vessel propulsion machine ventilation apparatus according to claim 1, wherein an oil regulation wall that regulates an inflow of oil in the device accommodation case toward the second ventilation film from a circumference outside of the second ventilation film is arranged in a circumference region of a side that faces the inside of the device accommodation case of the second ventilation film.

8. The marine vessel propulsion machine ventilation apparatus according to claim 1, wherein the first ventilation film is arranged in an attitude in which the film surface is along a vertical direction or in an attitude inclined relative to a horizontal plane.

9. A marine vessel propulsion machine, comprising:

a propulsion mechanism that propels a marine vessel;

a device accommodation case that accommodates at least part of the propulsion mechanism in an inside of the device accommodation case, at least part of the device accommodation case being submerged in an outside water; and a ventilation apparatus that permits a flow of air between the inside of the device accommodation case and an outside, wherein the ventilation apparatus comprises:

a first ventilation film that permits passing of a gas, prevents passing of a liquid, and has a first film surface which is one side of film surface facing an outside;

a second ventilation film that permits passing of a gas, prevents passing of a liquid, and has a second film surface which is one side of film surface facing the inside of the device accommodation case; and an air chamber which a third film surface which is an other side of another film surface of the first ventilation film and a fourth film surface which is an other side of film surface of the second ventilation film face.

10. The marine vessel propulsion machine ventilation apparatus according to claim 1, wherein the first ventilation film comprises a resin porous film.

11. The marine vessel propulsion machine ventilation apparatus according to claim 1, wherein the first ventilation film comprises polytetrafluoroethylene.

12. The marine vessel propulsion machine ventilation apparatus according to claim 1, wherein the second ventilation film comprises a resin porous film.

13. The marine vessel propulsion machine ventilation apparatus according to claim 1, wherein the second ventilation film comprises polytetrafluoroethylene.

14. The marine vessel propulsion machine according to claim 9, wherein the first ventilation film comprises a resin porous film.

15. The marine vessel propulsion machine according to claim 9, wherein the first ventilation film comprises polytetrafluoroethylene.

16. The marine vessel propulsion machine according to claim 9, wherein the second ventilation film comprises a resin porous film.

17. The marine vessel propulsion machine according to claim 9, wherein the second ventilation film comprises polytetrafluoroethylene.

* * * * *